US005218852A

United States Patent [19]

Watanabe et al.

[11] Patent Number: 5,218,852

[45] Date of Patent: Jun. 15, 1993

[54] MULTI-ROLL CLUSTER ROLLING APPARATUS

[75] Inventors: Yuichiro Watanabe; Kazuhito Kenmochi; Ikuo Yarita, all of Chiba, Japan

[73] Assignee: Kawasaki Steel Corporation, Kobe, Japan

[21] Appl. No.: 830,481

[22] Filed: Feb. 4, 1992

Related U.S. Application Data

[63] Continuation-in-part of Ser. No. 530,004, May 29, 1990, abandoned.

[30] Foreign Application Priority Data

| | | | |
|---|---|---|---|
| Jun. 5, 1989 | [JP] | Japan | 1-141057 |
| Jun. 5, 1989 | [JP] | Japan | 1-141058 |
| Jun. 5, 1989 | [JP] | Japan | 1-141059 |
| Jun. 9, 1989 | [JP] | Japan | 1-147958 |
| Jun. 9, 1989 | [JP] | Japan | 1-147959 |
| Jun. 9, 1989 | [JP] | Japan | 1-147960 |

[51] Int. Cl.[5] ..... B21B 13/00; B21B 31/18

[52] U.S. Cl. ..... 72/241.4; 72/242.4; 72/252.5

[58] Field of Search ..... 72/20, 21, 241.2, 241.4, 72/241.6, 241.8, 242.2, 242.4, 243.2, 243.4, 243.6, 247, 252.5, 365.2, 366.2

[56] References Cited

U.S. PATENT DOCUMENTS

| | | | |
|---|---|---|---|
| 3,858,424 | 1/1975 | Kajiwara et al. | 72/242.4 |
| 4,440,012 | 4/1984 | Feldmann et al. | 72/243.6 |
| 4,798,074 | 1/1989 | Feldmann et al. | 72/199 |
| 4,805,433 | 2/1989 | Rennebaum | 72/242.4 |

FOREIGN PATENT DOCUMENTS

| | | | |
|---|---|---|---|
| 0190705 | 11/1982 | Japan | 72/242.4 |
| 0232007 | 10/1986 | Japan | 72/242.4 |
| 0057703 | 3/1987 | Japan | 72/243.6 |
| 1443997 | 12/1988 | U.S.S.R. | 72/242.4 |

*Primary Examiner*—Lowell A. Larson
*Assistant Examiner*—Thomas C. Schoeffler
*Attorney, Agent, or Firm*—Dvorak and Traub

[57] ABSTRACT

A multi-roll cluster rolling apparatus has a pair of work rolls, and a plurality of first intermediate rolls, a plurality of second intermediate rolls and a plurality of backup rolls arranged successively in the mentioned order behind each the work roll. A roll crown presented by unidirectinally tapering one end of a roll is imparted to at least a pair of rolls, e.g., the work rolls, selected from a roll group consisting of the work rolls, first intermediate rolls and the second intermediate rolls. A roll crown approximated by at least one-pitch portion of a waveform is imparted to at least one other pair of rolls, e.g., pairs of the first intermediate rolls. A roll crown approximated by at least two-pitch portion of a waveform is imparted to at least one of the remainder pairs of rolls, e.g., selected pairs of the second intermediate rolls. The rolls of each pair having the same roll crown arranged arranged in opposite axial directions and are axially shiftably mounted on a mill housing.

5 Claims, 17 Drawing Sheets

Before shift

After shifting 50mm

Conventional Method

Before shift

After shifting 50mm

Example of the W-Crown Roll

Example of the Invention

MULTI-ROLL CLUSTER ROLLING APPARATUS

This application is a continuation-in-part of application Ser. No. 07/530,004, filed May 29, 1990, abandoned.

BACKGROUND OF THE INVENTION

The present invention relates to a multi-roll cluster rolling apparatus of the 12-high or 20-high class having superior flatness control characteristic.

DESCRIPTION OF THE RELATED ART

In recent years, multi-roll cluster rolling apparatus of 12-high or 20-high class has usually been used for cold rolling of materials which are difficult to work, e.g., stainless steels and silicon steels. This type of multi-roll cluster rolling apparatus offers an advantage in that, since the work rolls can have a reduced diameter, rolling at a large reduction ratio is possible with a smaller rolling load than in conventional vertical rolling mills. On the other hand, however, this type of rolling apparatus suffers from a disadvantage in that the cross-sectional shape or flatness of the rolled products tends to be degraded due to greater tendency of work roll deflection attributable to the reduction in the diameter of the work rolls.

Hitherto, various countermeasures have been proposed to obviate this problem.

For instance, a method has been proposed in which the outermost backup rolls are axially divided into a plurality of segments and the amounts of axial displacements of these roll segments are suitably adjusted to control the profile of the rolled product. The merit of this method, however, could not be fully enjoyed when the rolling apparatus is of multi-roll type having many intermediate rolls, such as 12-high or 20-high rolling mills, because the effect of control of the outermost backup rolls is absorbed by such many intermediate rolls.

In order to overcome this problem, a method has been proposed in, for example, Japanese Patent Unexamined Publication No. 58-50108, in which work roll benders and intermediate roll benders are used in combination with the control of displacements of the outermost backup roll segments mentioned above. This method, however, requires a highly complicated control mechanism. In addition, appreciable control effect is obtained only at both breadthwise ends of the rolled material when the roll diameters are reduced and when the roll barrel lengths are increased, because in such cases the bending force effect can hardly reach the breadthwise central portion of the material.

A method has been proposed in, for example, Japanese Patent Unexamined Publication No. 63-207405 in which intermediate rolls are tapered in axial direction at one their ends, and such tapered intermediate rolls are independently shifted in the axial directions. In this method, the control effect can be obtained only in the regions near the tapered portions of these intermediate rolls. In addition, it is difficult to change the intermediate rolls to employ different degrees of tapers in accordance with a change in the rolling conditions, such as the type of the steel to be rolled and the width of the rolled product to be obtained.

A vertically-arranged rolling apparatus disclosed in, for example, Japanese Patent Unexamined Publication No. 63-30104 employs axially shiftable rolls provided with S-crowns the dimension of which can be approximated by cubic equations. This rolling apparatus, however, is not a multi-roll cluster rolling mill. In addition, this rolling apparatus can produce the control effect only on both breadthwise ends and the central portion of the rolled material, and cannot satisfactorily prevent defects such as quarter elongation and composite elongation which is produced by combination of a center buckle and an edge wave.

SUMMARY OF THE INVENTION

Accordingly, an object of the present invention is to provide a multi roll cluster rolling apparatus of the 12-high or 20-high class having superior profile control performance and capable of effecting correction of complicated profile defect such as quarter elongation and edge/center composite elongation, not to mention simple defects such as center buckle and edge wave, as well as correction of any edge drop, thereby overcoming the abovedescribed problems of the known art.

To this end, according to one aspect of the present invention, there is provided a multi-roll cluster rolling apparatus having a pair of work rolls, and a plurality of first intermediate rolls, a plurality of second intermediate rolls and a plurality of backup rolls arranged successively behind each the work roll. A roll crown formed by unidirectionally tapering one end of a roll, appears on at least a pair of rolls selected from a roll group consisting of the work rolls, first intermediate rolls and the second intermediate rolls. A roll crown approximated by at least one-pitch portion of a waveform is imparted to at least one other pair of rolls selected from the roll group. A roll crown approximated by at least two-pitch portion of a waveform is imparted to at least one of the remaining pairs of rolls selected from the roll group, the rolls of each pair having the same roll crown being arranged in opposite axial directions and being axially shiftably mounted on a mill housing.

The above and other objects, features and advantages of the present invention will become clear from the following description of the preferred embodiments when the same is read in conjunction with the accompanying drawings.

Figure 7:
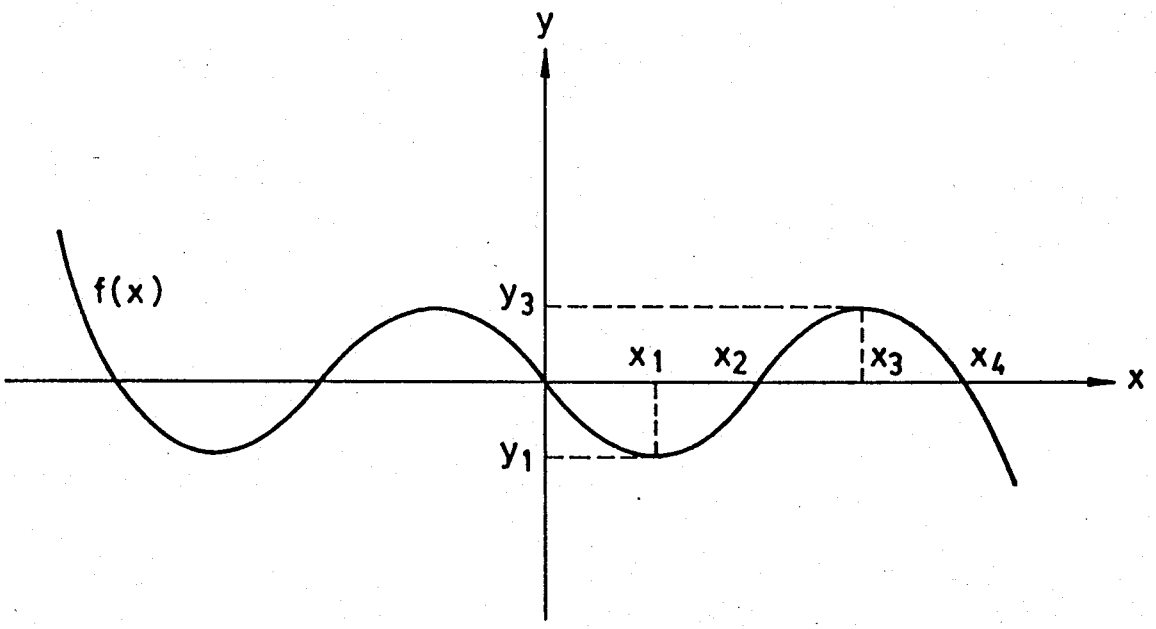
Figure 8A:
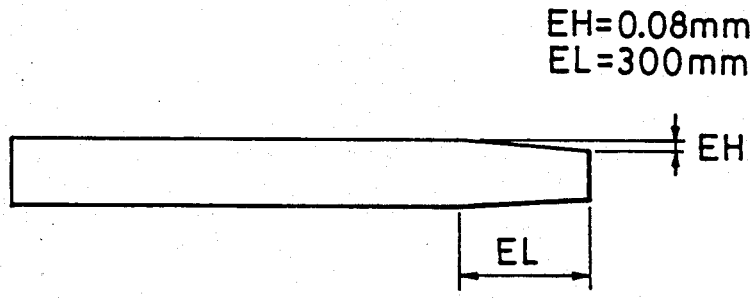
Figure 8B:
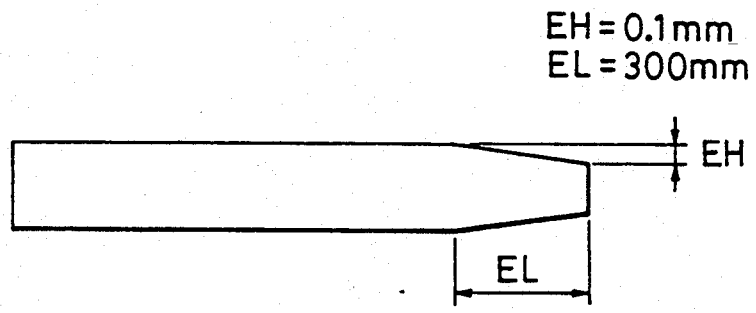
Figure 8C:
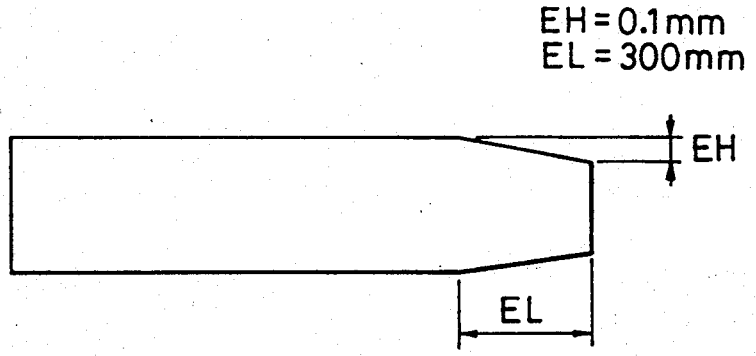
Figure 9:
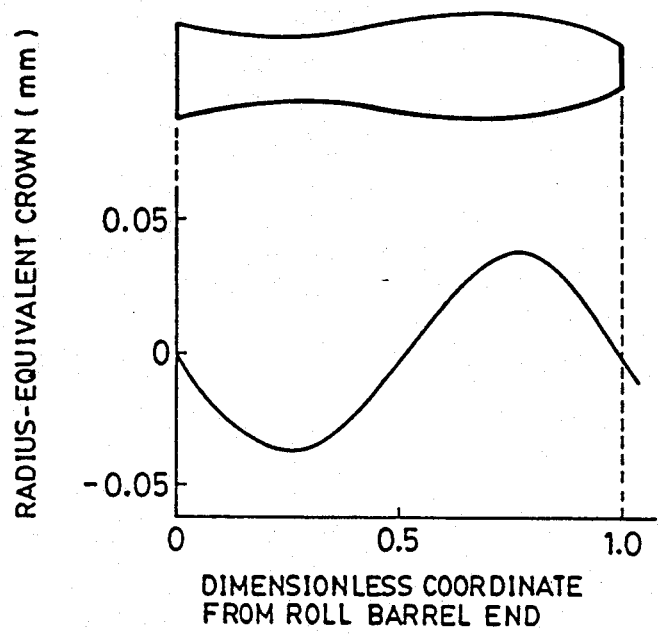
Figure 10:
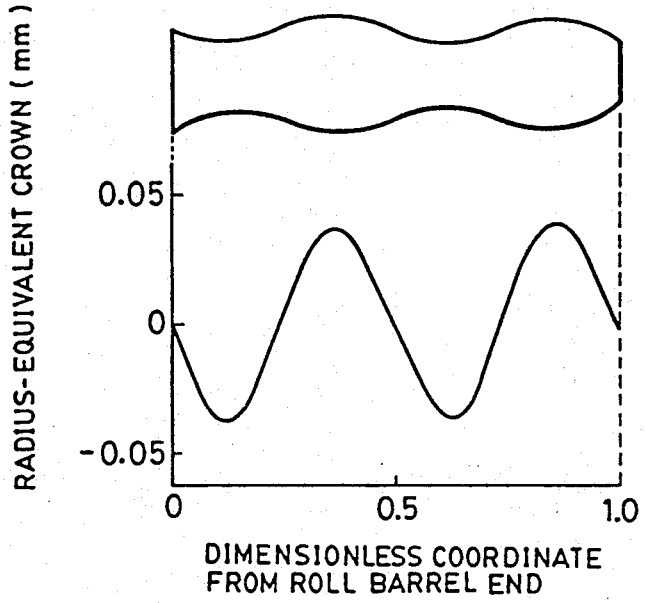
Figure 11:
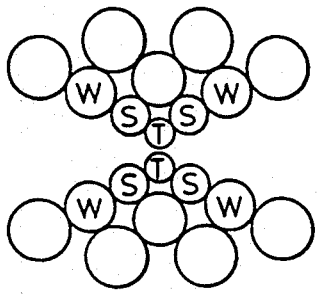
Figure 11:
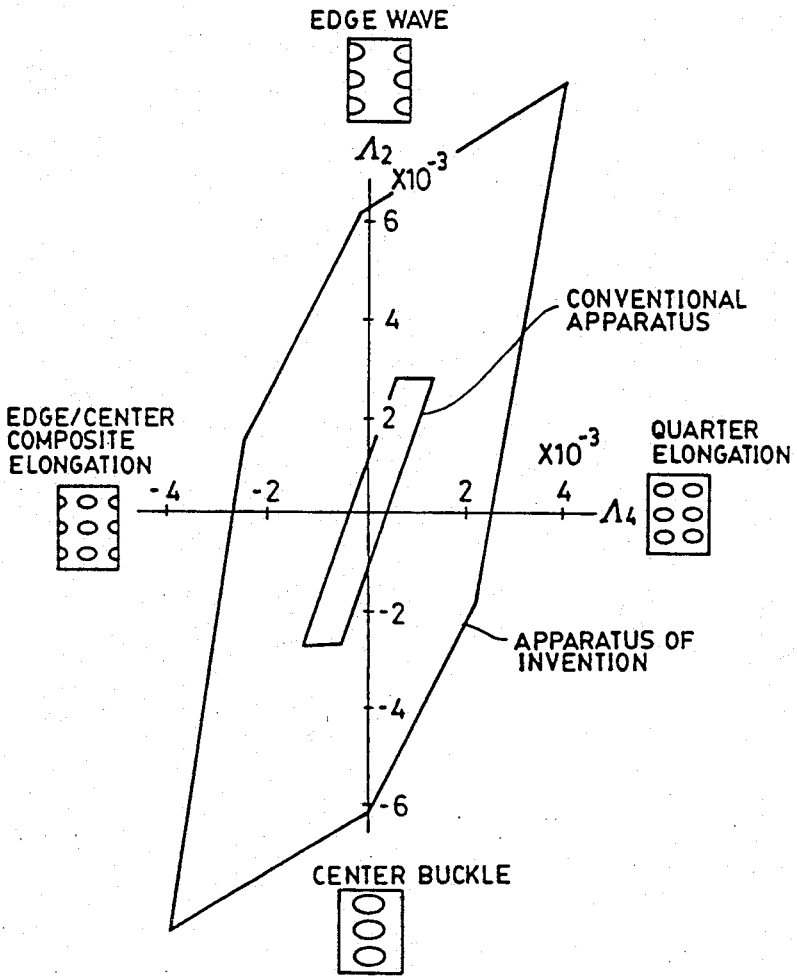
Figure 13A:
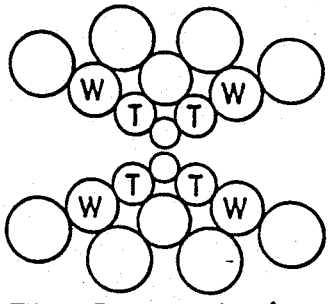
Figure 13B:
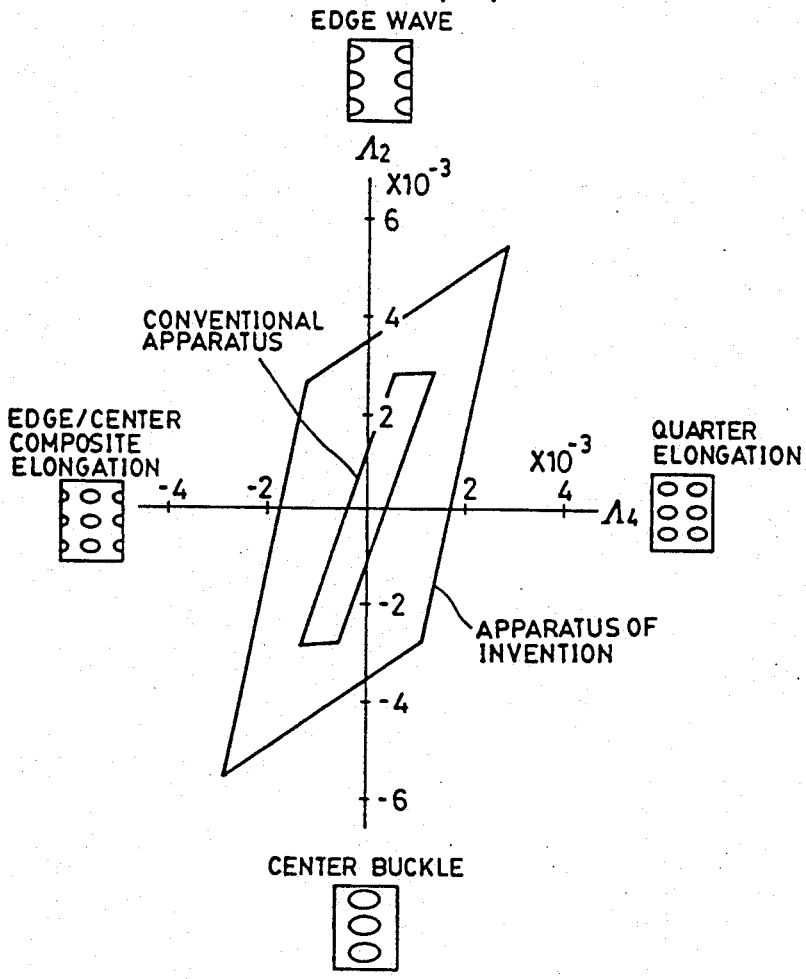
Figure 14:
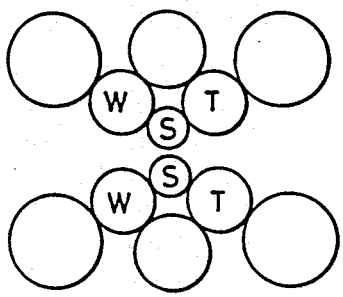
Figure 14:
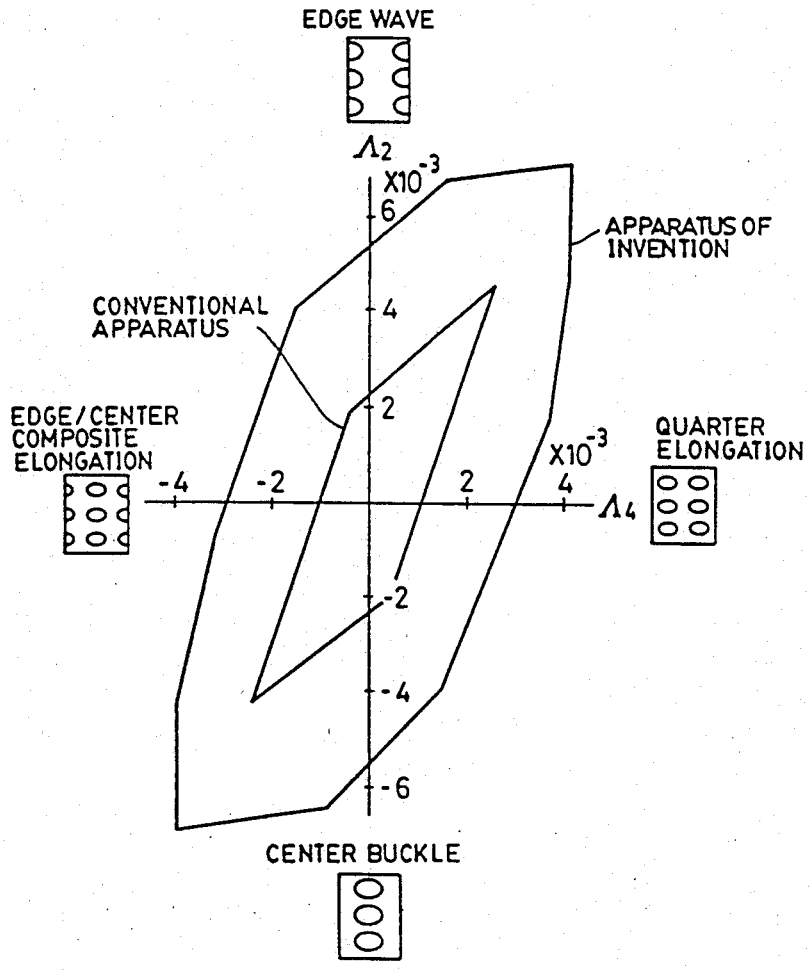
Figure 15A:
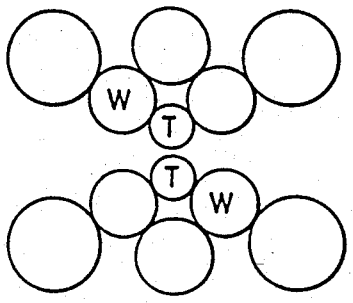
Figure 15B:
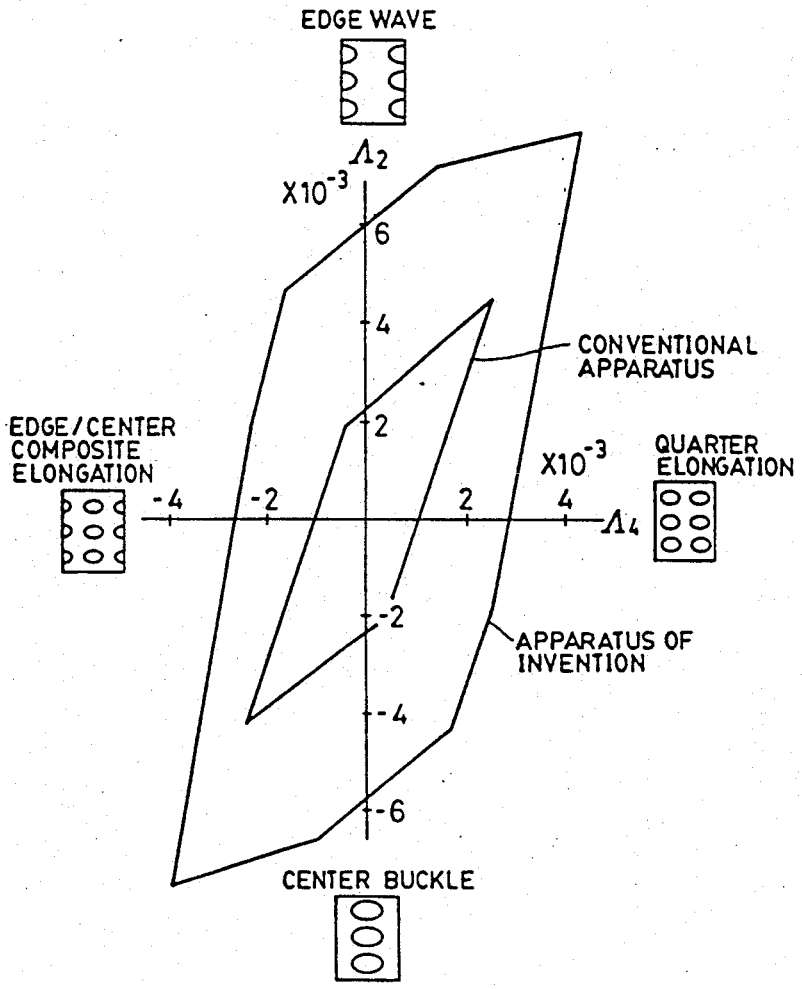
Figure 16A:
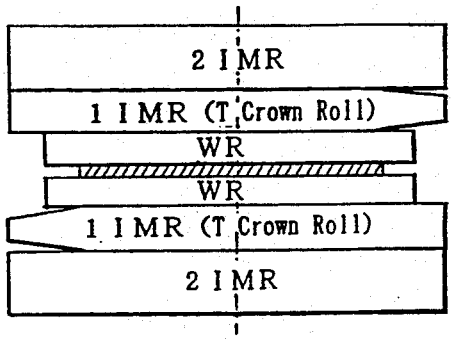
Figure 16B:
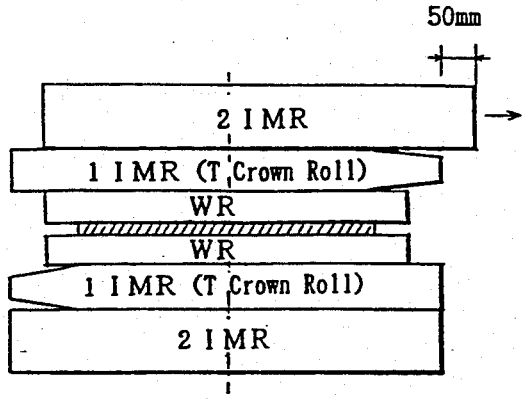
Figure 17:
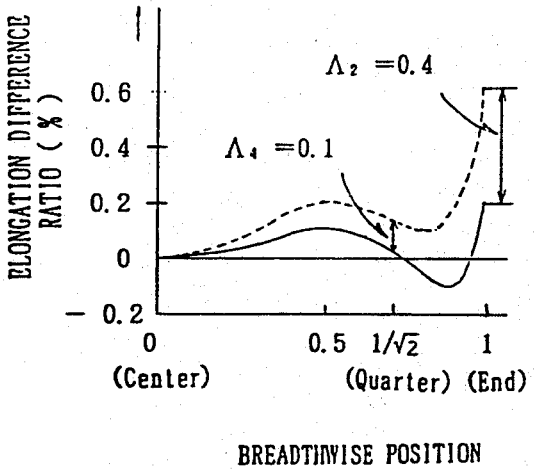
Figure 18:
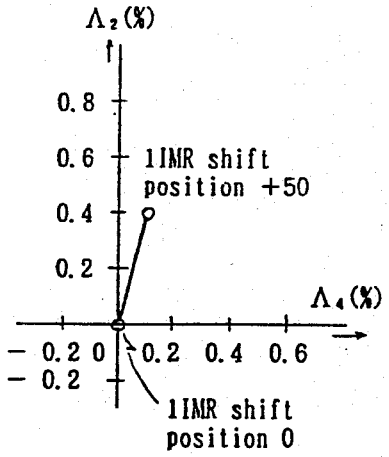
Figure 19A:
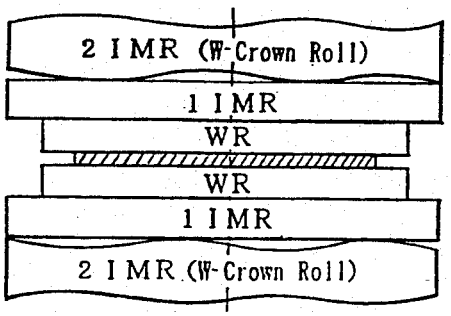
Figure 19B:
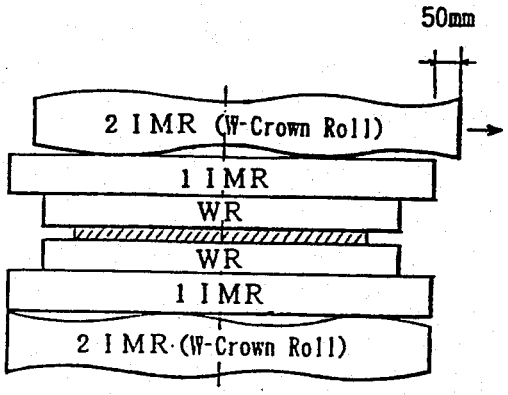
Figure 20:
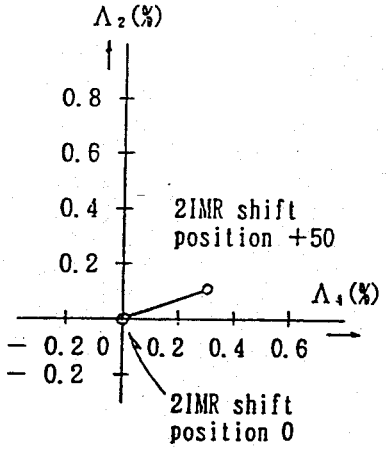
Figure 21:
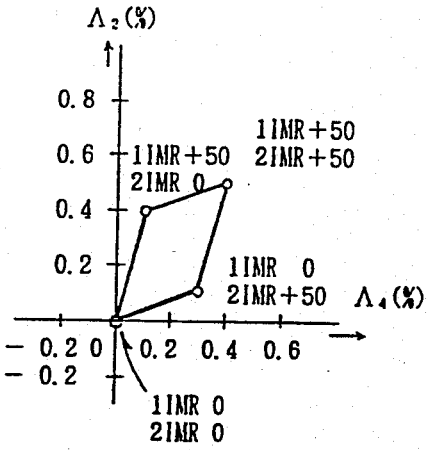
Figure 22:
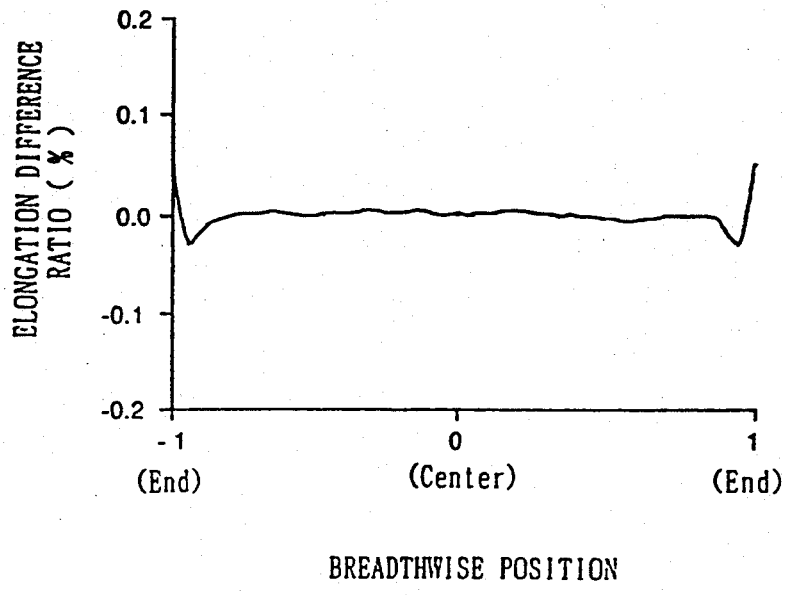
Figure 23:
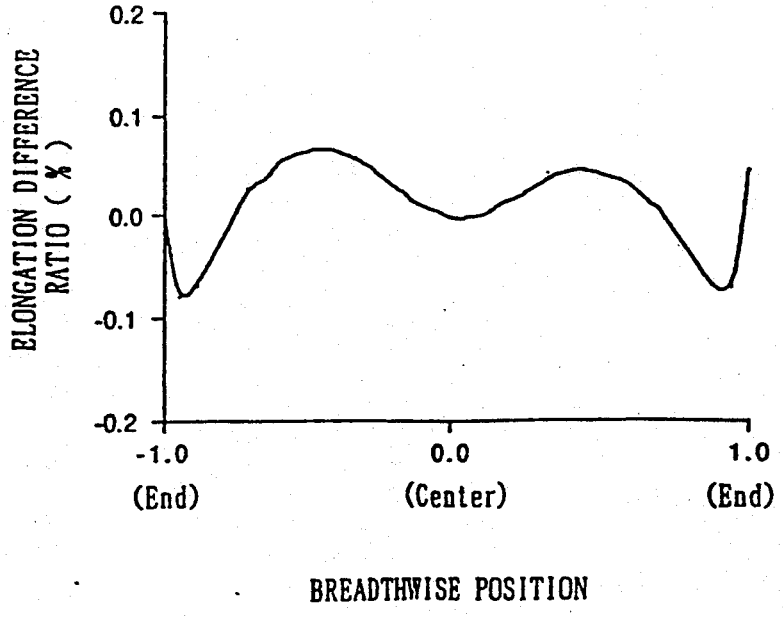

FIG. 7 is an illustration of a W-crown which can be approximated by a formula of a high order;

FIGS. 8*a*, 8*b* and 8*c* are illustrations of tapers of a single-end-tapered rolls;

FIG. 9 is an illustration of an S-crown which can be approximated by two pitches of a sine-wave curve;

FIG. 10 is an illustration of a W-crown roll which can be approximated by pitches of a pair of sine-wave curves;

FIG. 11*a* is a side elevational view of a 20-high rolling apparatus using a combination of S-, T-, and W-crown rolls, and FIG. 11*b* is a graph showing a profile-controllable range of the 20-high rolling apparatus;

FIGS. 12*a*,12*b* and 13*a*, 13*b* are illustrations showing arrangements of T-crown rolls, W-crown rolls and S-crown rolls in a 20-high rolling apparatus, as well as profile controllable ranges;

FIG. 13*a* is a side elevational view of a 20-high rolling apparatus using a combination of T- and W-crown rolls, and FIG. 13*b* is a graph showing a profile-controllable range of the 20-high rolling apparatus;

FIGS. 14*a*, 14*b* and 15*a*, 15*b* are illustrations showing arrangements of T-crown rolls, W-crown rolls and S-crown rolls in a 12-high rolling apparatus, as well as profile controllable ranges; and FIG. 15*a* is a side elevational view of a 12-high rolling apparatus using a combination of T- and W-crown rolls, and FIG. 15*b* is a graph showing a profile-controllable range of the 12-high rolling apparatus;

FIG. 16A illustrates T rolls before shift;

FIG. 16B illustrates T rolls after shift;

FIG. 17 illustrates the Breadthwise position;

FIG. 18 is a graph of the values of FIG. 17;

FIG. 19A illustrates a w crown roll before shift;

FIG. 19B illustrates a w crown roll after shift;

FIG. 20 illustrates elongation ratios;

FIG. 21 illustrates elongation ratios;

FIG. 22 is a graph illustrating the ratio of difference in elongation as observed in the breadthwise direction of a material rolled by the apparatus of the present invention; and FIG. 23 is a graph illustrating the ratio of difference in elongation as observed in the breadthwise direction of a material rolled by a conventional rolling apparatus.

DESCRIPTION OF THE PREFERRED EMBODIMENTS

Preferred embodiments of the present invention will be described with reference to the drawings.

Figure 1A:
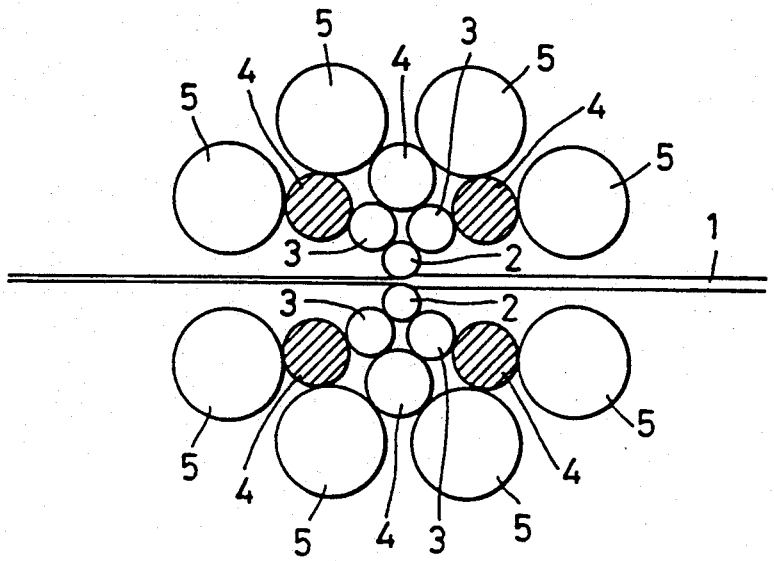
FIGS. 1*a* and 1*b* are a side elevational view and a front elevational view of a 20-high rolling apparatus to which the present invention is applied.
Figure 1B:
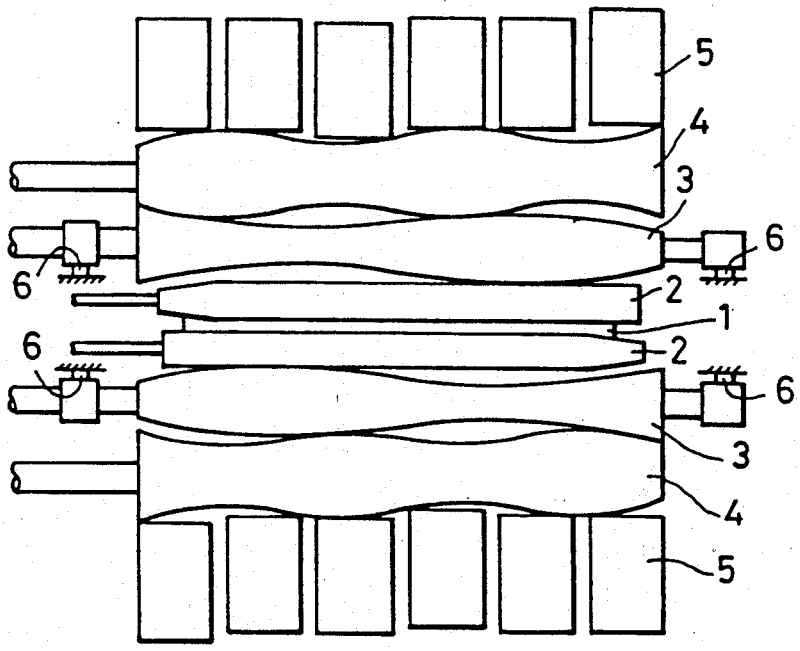
Figure 2A:
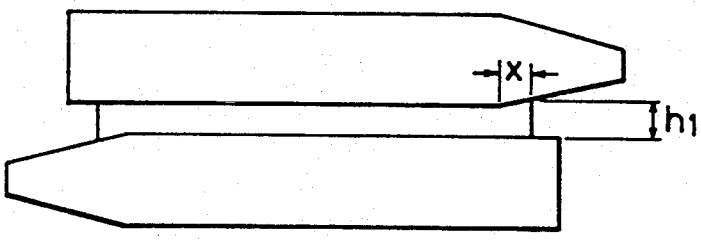
FIGS. 2*a* to 2*d* are schematic illustrations showing a change in the roll gap as observed when parallel T-crown rolls, which are arranged in opposite directions, are shifted in the direction of the roll axis.
Figure 2B:
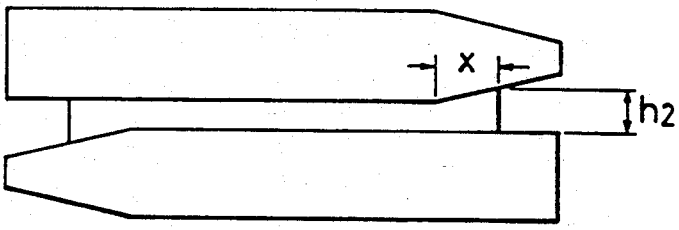
Figure 2C:
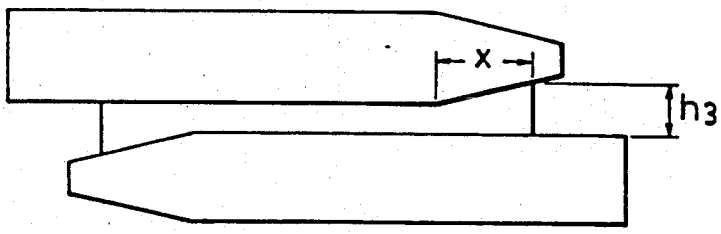
Figure 2D:
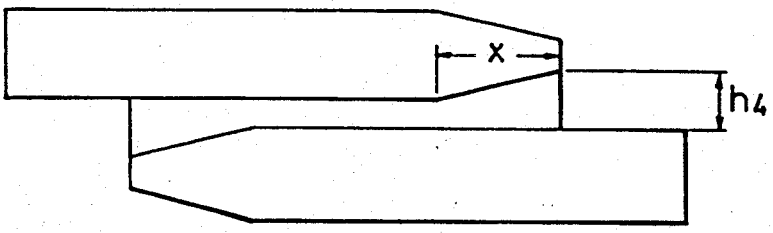

FIGS. 1*a* and 1*b* are a side elevational view and a front elevational view of a multi-roll cluster rolling apparatus in accordance with the present invention. A material under rolling is denoted by 1. The rolling apparatus has work rolls 2, first intermediate rolls 3, second intermediate rolls 4 and divided-type backup type rolls 5. More specifically, upper and lower work rolls 2, 2 are arranged to oppose each other across the rolled material 1. Two first intermediate rolls 3,3 are arranged behind each work roll 2. Thus, there are four first intermediate rolls 3 in total. There are three second intermediate rolls 4,4,4 behind the pair of first intermediate rolls 2,2 at each side of the rolled material 1. Thus, six second intermediate rolls 4 are employed in total. The three second intermediate rolls 4,4,4 on each side of the rolled material 1 are backed up by four divided-type backup rolls 5. Thus, there are eight backup rolls 5 in total. It will be seen that the pair of work rolls 2, four first intermediate rolls 3, six second intermediate rolls 4 and eight backup rolls 5, in cooperation, form the 20-highrolling apparatus. The work rolls 2, first intermediate rolls 3 and the second intermediate rolls 4 are independently shiftable in the axial directions by conventional hydraulic or electrical shifting devices (not shown).

Numeral 6 designate roll bending devices.

FIGS. 2*a* to 2*d* show the manner in which the roll gap between parallel single-end-tapered rolls is changed in accordance with axial shifts of these rolls. These rolls are tapered by grinding only at their one axial end regions which are opposite to each other, and will be referred to as "T-crown rolls" hereinafter.

As will be seen from these Figures, it is possible to reduce any edge drop by varying the width (x) of the breadthwise end regions of the material rolled by the tapered portions of the roll, by suitably controlling the axial shift of the T-crown rolls.

Figure 3A:
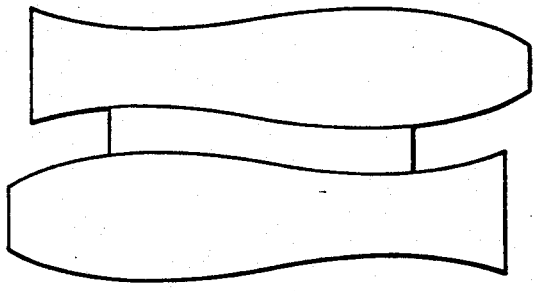
FIGS. 3*a* to 3*c* are schematic illustrations showing a change in the roll gap as observed when parallel S-crown rolls, which are arranged in opposite directions, are shifted in the direction of the roll axis.
Figure 3B:
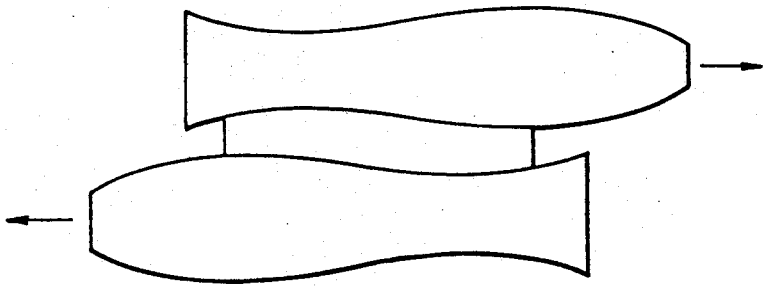
Figure 3C:
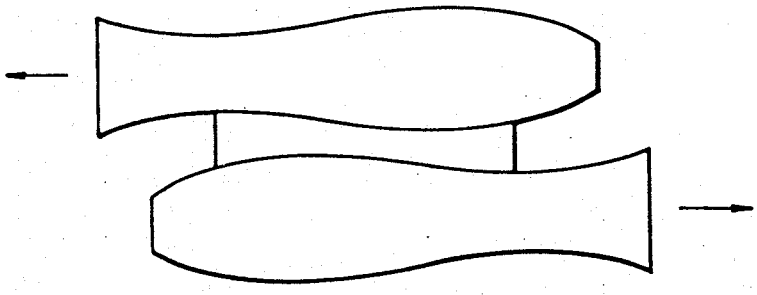

FIGS. 3*a* to 3*c* show the manner in which the roll gap between a pair of rolls is changed in accordance with axial shifts of these rolls, the rolls having a roll crown of a waveform approximated by one pitch of sine wave (referred to simply as "S-crown roll") and arranged in opposite directions.

In the state shown in FIG. 3*a*, both rolls are vertically aligned with each other so as to provide a constant gap therebetween along the length of these rolls. In the state shown in FIG. 3*b*, the rolls have been moved in opposite directions from the positions shown in FIG. 3*a*, so as to provide a roll gap which is large at the center and small at both breadthwise ends. In the state shown in FIG. 3*c*, the rolls have been moved in the directions counter to those in FIG. 3*b*, so as to provide a roll gap which is small at the center and large at both breadthwise ends.

Figure 4A:
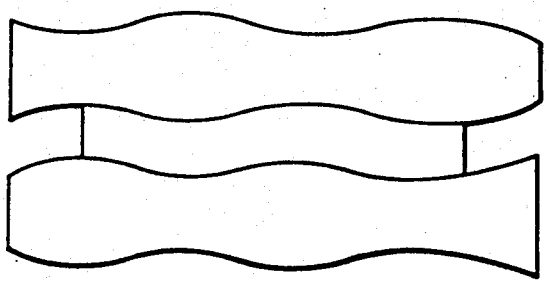
FIGS. 4*a* to 4*c* are schematic illustrations showing a change in the roll gap as observed when parallel W-crown rolls, which are arranged in opposite directions, are shifted in the direction of the roll axis.
Figure 4B:
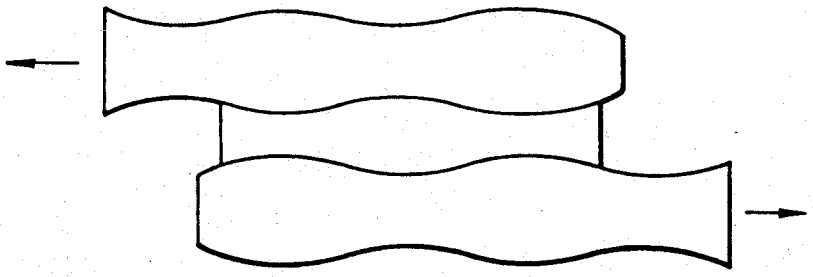
Figure 4C:
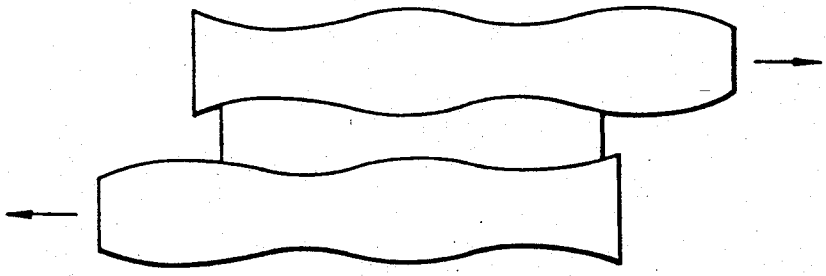

FIGS. 4*a* to 4*c* show the manner in which the roll gap between a pair of rolls is changed in accordance with axial shifts of these rolls, when the rolls have a roll crown of a waveform approximated by two pitches of sine wave (referred to simply as "W-crown roll") and are arranged in opposite directions.

In the state shown in FIG. 4*a*, both rolls are vertically aligned with each other so as to provide a constant gap therebetween along the length of these rolls. In the state shown in FIG. 4*b*, the rolls have been moved in opposite directions from the positions shown in FIG. 4*a*, so as to provide a roll gap which is large at the center and both breadthwise ends and small at the quarter portions. In the state shown in FIG. 4*c*, the rolls have been moved in the directions counter to those in FIG. 4*b*, so as to provide a roll gap which is small at the center and both breadthwise ends and large at the quarter portions.

Figure 5:
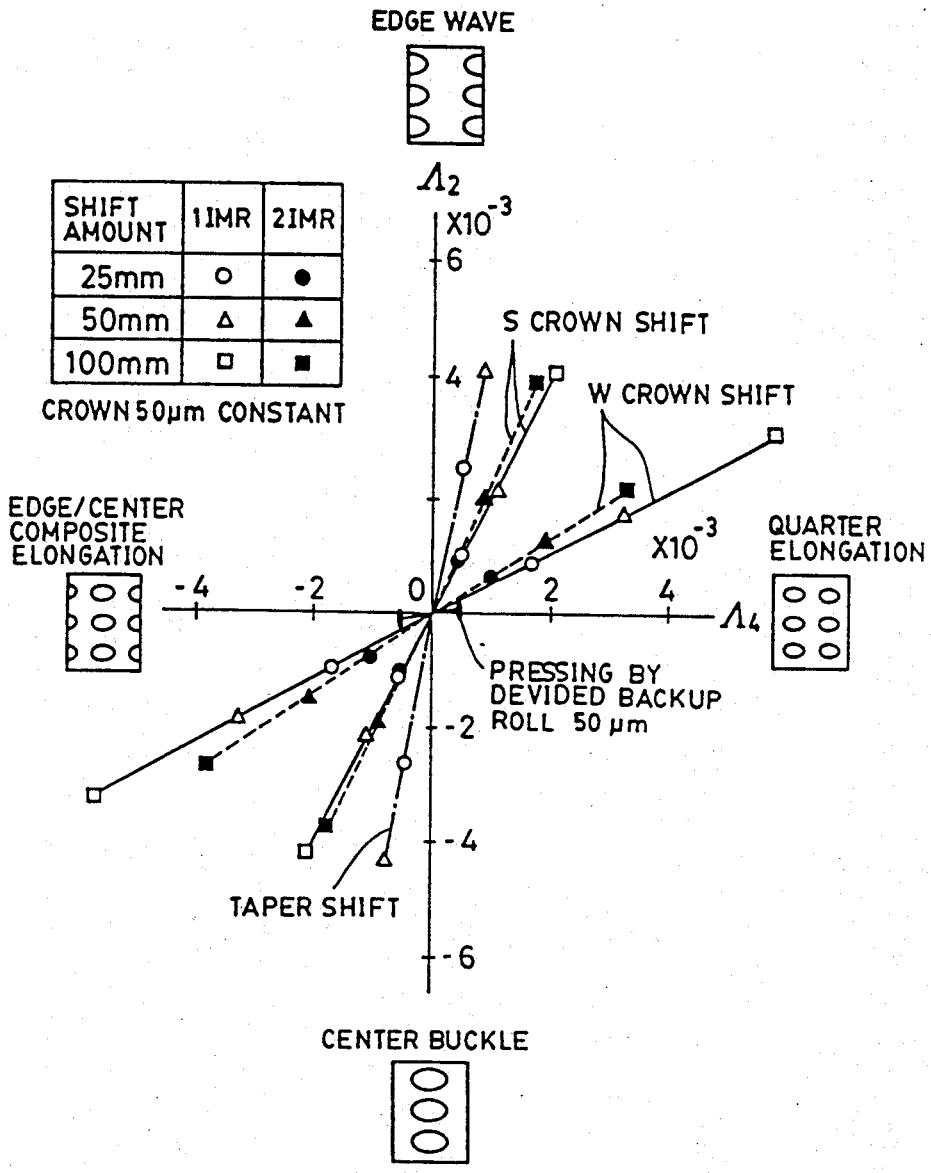
FIG. 5 is a graph showing profile control performance of the 20-high rolling apparatus obtained when a pair of T-crown rolls, a pair of S-crown rolls and a pair of W-crown rolls are used as first or second intermediate rolls, respectively.

A 20-high rolling apparatus of the type shown in FIG. 1 was built up by using pair of T-crown rolls as the first intermediate rolls, and a pairs of S- or W-crown rolls as the second intermediate rolls. A test was conducted to examine the profile control performance of this rolling apparatus by independently shifting these intermediate rolls. The results of this test are shown in FIG. 5 in comparison with the case where the backup roll sections corresponding to the quarter portions are forced out.

The profile control performance can be expressed in terms of an elongation difference ratio $\Lambda_2$ representing the degree of difference between the elongation at the central portion and the elongation at breadthwise ends of the rolled material, and an elongation difference ratio $\Lambda_4$ representing the degree of difference between the elongation at the central portion and the elongation at quarter portions of the rolled material, the ratios $\Lambda_2$ and $\Lambda_4$ being respectively expressed by the following formulae:

$$\Lambda_2=(l_2-l_0)/l_0$$

where $l_0$ represents the length (mm) of the material after roller as measured at breadthwise mid portion of the material and $l_2$ represents the length (mm) of the material after rolling as measured at breadthwise end portion of the material.

$$\Lambda_4=(l_4-l_0)/l_0$$

where $l_4$ represents the length (mm) of the material after rolling as measured at breadthwise quarter of the material.

In FIG. 5, lengths of straight lines represent the level of the profile control performance, while the gradients of the lines represent the ratios of controls of elongations.

For instance, large gradients of the lines representing the characteristics obtained when the T- or S-crown rolls are shifted alone show that such roll shifts are effective in the control of edge wave and center buckle but no substantial effect is expectable in regard to the control of the quarter elongation and the edge/center composite elongation.

The control by force-out of the backup roll segments is represented by a line which has a very small gradient. Thus, this method can provide only a small effect in the control of the quarter elongation and the edge/center composite elongation and cannot provide any substantial effect in the control of edge wave and center buckle.

Shifting of the W-crown rolls alone can provide an appreciable effect in the control of the quarter elongation and the edge/center, but is quite ineffective in the control of the edge wave and the center buckle.

Another 20-high rolling apparatus of the type shown in FIG. 1 was built up by using T-, S- and W-crown rolls as the work rolls, first intermediate rolls and the second intermediate rolls, respectively, and the profile correction performance of this rolling apparatus was examined. The result is shown in FIG. 6 together with the results of the same investigation conducted on a conventional apparatus which incorporated T-crown rolls as the first intermediate rolls in combination with roll benders and also with divided backup roll force-out method.

Figure 6:
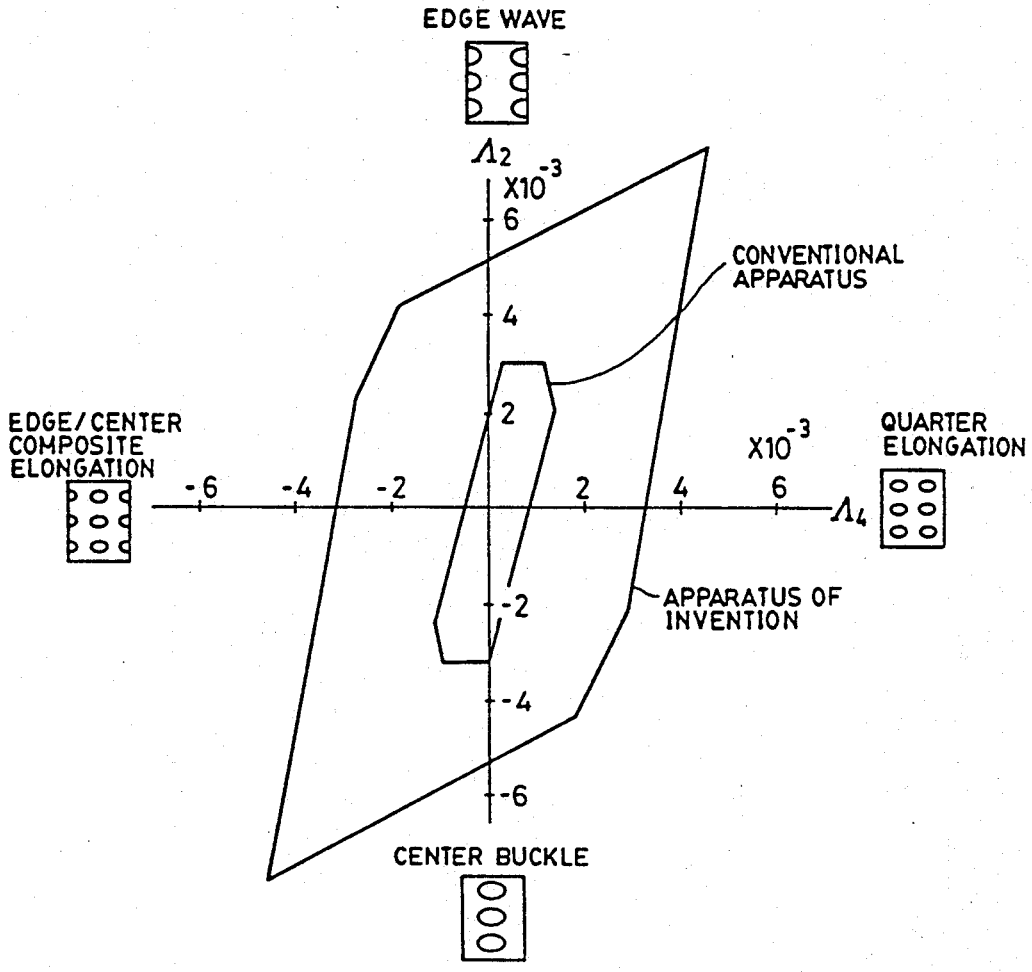
FIG. 6 is a graph showing a profile-controllable range of the 20-high rolling apparatus as obtained when T-crown rolls are used as the work rolls while W-crown rolls and S-crown rolls are respectively used as the first and second intermediate rolls.

As will be understood from FIG. 6, the rolling apparatus of the present invention which employs T-, S- and W-crown rolls in combination and which relies upon suitable axial shifts of these rolls, exhibited superior effect in correcting quarter elongation, composite elongation and edge drop, not to mention simple edge wave and center buckle. It is thus understood that the apparatus of the present invention can conduct a flatness control over wide ranges. This should be contrasted to the conventional apparatus which could provide certain effects on the control of the edge wave and the center buckle but no substantial effect in the correction of edge/center composite elongation and quarter elongation.

Thus, in the rolling apparatus of the present invention, the merits of different types of roll crown are combined while demerits are canceled, thus overcoming the difficulty in the flatness control caused in current rolling apparatus having rolls of large length-to-diameter (L/D) ratio values and incorporating a large number of intermediate and backup rolls.

According to the invention, the roll pairs which are to be T-. S- and W-crowned may be any pair or pairs of rolls selected from the roll groups consisting of the work rolls, first intermediate rolls and the second intermediate rolls. It is, however, preferred that the pair of rolls to which the crown of the same type is applied belong to the same roll group, i.e., to the group consisting of the work rolls, group consisting of the first intermediate rolls or the group consisting of the third intermediate groups. The types and degrees of the rolling defects vary depending on the type of the steel material to be rolled and also on the rolling conditions. The types of roll crown and the rolls to which these crowns are imparted are determined in consideration of the types and degrees of such rolling defects. It is, however, generally recognized that a greater control effect is obtained when the T-, S- or W-crown rolls are disposed closer to the rolled material. In addition, greater, medium and a smaller effects are obtained when the pair of the rolls of the same crown type are arranged in symmetry with respect to a point, a horizontal plane and a vertical plane.

The invention does not exclude a simultaneous use of roll benders. A greater effect on elongations at the edges such as edge wave will be obtained when roll benders are used in combination with the roll arrangement of the present invention.

The waveforms or curves of the crown to be imparted may be one- or two-pitch section of a sine-wave curve or a curve of a function of three or higher orders, as well as curves approximating these curves, among which one- or two-pitch portion of a sine-wave curve or a curve approximating such a curve is used most suitably.

EXAMPLES

EXAMPLE 1

A 20-high rolling apparatus of the type shown in FIG. 1 was built-up using single-end-tapered T-crown rolls of FIG. 8*a* as the work rolls, S-crown rolls of the type shown in FIG. 9 approximated by one-pitch of a sine-wave curve as all the first intermediate rolls 3, and W-crown rolls of FIG. 10 approximated by two-pitch portion of a sine wave curve as selected second intermediate rolls which are hatched in FIG. 1.

A test rolling was conducted to roll a stainless steel sheet of 1000 mm wide from 1.2 mm down to 1.0 mm, while axially shifting the work rolls, first intermediate rolls and the second intermediate rolls in various manners.

FIG. 11*a* shows the above-mentioned roll arrangement, while FIG. 11*b* shows the range of profile control which can be covered by this rolling apparatus. FIG. 11*b* also shows the results of the same test rolling reduction conducted to examine the profile control performance of a known rolling apparatus which incorporated axially-shiftable single-end tapered rolls of the type shown in FIGS. 8*b* and 8*c* as the first and second intermediate rolls, together with a control by force-out of segments of divided backup rolls.

As will be seen from FIG. 11*b*, the known apparatus could effect the profile control only in a small range. In particular, ability to correct composite elongation and quarter elongation is very small. Due to the small range of the profile control, this known apparatus require a change in the taper of the first or second intermediate rolls depending on conditions such as the kind and breadth of the material to be rolled.

In contrast, the rolling apparatus embodying the invention exhibited an ability to correct all types of elongations including composite and quarter elongations over wide ranges, and could effect a good profile control for a variety of types of the rolled material without requiring change of the intermediate rolls.

EXAMPLE 2

Figure 12A:
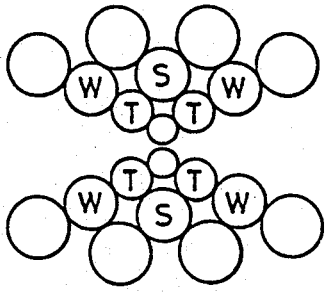
Figure 12B:
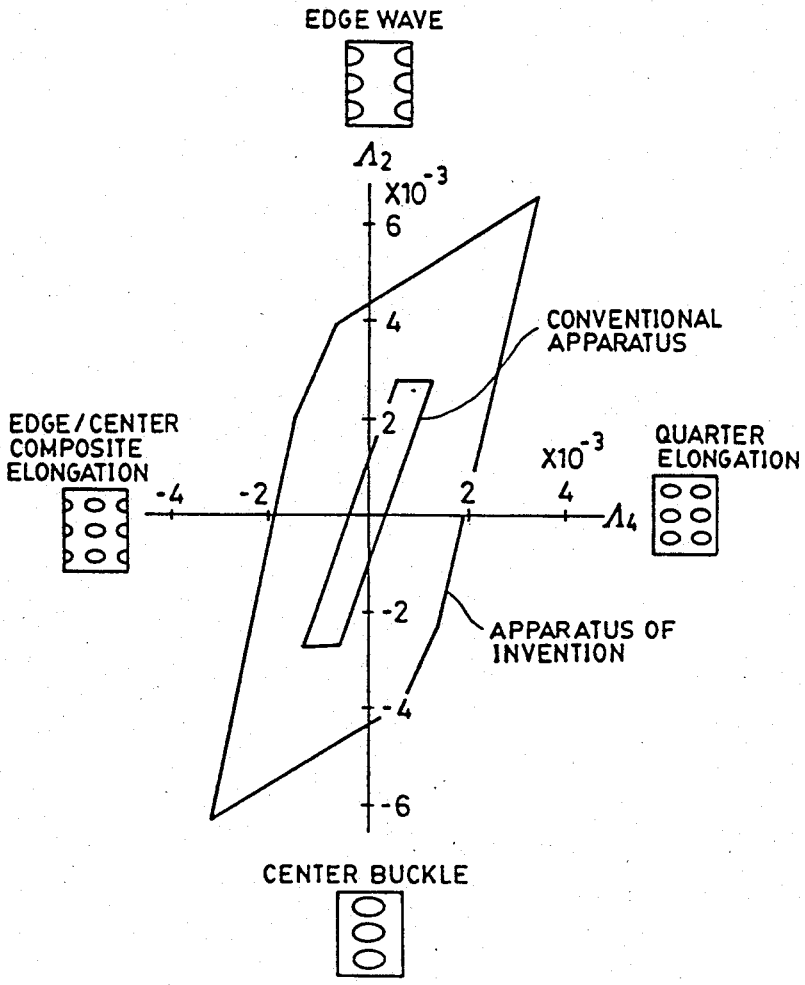

A 20-high rolling apparatus of the type shown in FIG. 1 was built-up by using, as shown in FIG. 12*a*, T-crown rolls of FIG. 8*b* as the first intermediate rolls, W-crown rolls of FIG. 10 approximated by two-pitch portion of a sine-wave curve as the outer four intermediate rolls, i.e., left and right pairs of the second intermediate rolls, and S-crown rolls of FIG. 9 approximated by one-pitch portion of a sine-wave curve as the central pair of the second intermediate rolls. Using this rolling apparatus, a test rolling was conducted under the same conditions as Example 1 to examine the profile control ability of this apparatus, the results being shown in FIG. 12*b*.

EXAMPLE 3

A 20-high rolling apparatus of the type shown in FIG. 1 was built-up by using, as shown in FIG. 13*a*, T-crown rolls of FIG. 8*b* as the first intermediate rolls, and W-crown rolls of FIG. 10 approximated by two-pitch portion of a sine-wave curve as the outer four intermediate rolls, i.e., left and right pairs of the second intermediate rolls. Using this rolling apparatus, a test rolling was conducted under the same conditions as Example 1 to examine the profile control ability of this apparatus, the results being shown in FIG. 13*b*.

Dimensions and contours of the rolls used in this Example are shown in Table 1 below.

| Roll Name | Roll dia. (mm) | Barrel length (mm) | Roll contour |
|---|---|---|---|
| Work Rolls | 50 mm | 1394 mm | plane roll |
| 1st Intermediate Rolls | 102 mm | 1448 mm | T-crown |
| 2nd Intermediate Rolls | 173 mm | 1334 mm | both ends: W-crown Center: plane |
| Backup rolls | 300 mm | 173 mm × 6 | Divided plane roll |

The conventional rolling apparatus employed had rolls of the same dimensions as those of the rolls used in the apparatus of the invention and the contours of these rolls used in the conventional apparatus were the same as those described in connection with Example 1.

FIGS. 22 and 23, respectively, show the ratio of difference in elongation as observed in the breadthwise direction of a material rolled by the apparatus of the present invention and that of a material rolled by a conventional rolling apparatus.

As will be understood from FIG. 13(*b*) and FIG. 23, the conventional rolling apparatus provides a comparatively large value of the end elongation difference ratio $\Lambda_2$ and, hence, produces an appreciable effect on correction of edge wave of the rolled strip. It is also understood, however, the conventional apparatus does not offer any significant effect on the control of the elongation at the quarter portions of the strip, as well as center/edge composite elongation, because of the too small quarter elongation difference ratio $\Lambda_4$.

In contrast, the apparatus of the present invention produces a remarkable effect in leveling and flattening of the strip, by virtue of the large values of the end elongation difference ratio $\Lambda_2$ and the quarter elongation difference ratio $\Lambda_4$, as will be seen from FIG. 13(*b*) and FIG. 22.

EXAMPLE 4

A 12-high rolling apparatus of the type shown in FIG. 13*a* was built-up by using, as shown in FIG. 14*a*, S-crown rolls of FIG. 9 approximated by one-pitch portion of a sine-wave curve as the work rolls, W-crown rolls of FIG. 10 approximated by two-pitch portion of a sine-wave curve as the rolls of one of the left and right pairs of the intermediate rolls, each pair including an upper roll and a lower roll, and T-crown rolls of FIG. 8*b* as the rolls of the other of the left and right pairs of the intermediate rolls. Using this rolling apparatus with simultaneous use of the divided backup roll force-out control and roll benders, a test rolling was conducted under the same conditions as Example 1 to examine the profile control ability of this apparatus. The result is shown in FIG. 14*b*. FIG. 14*b* also shows the results of the same test rolling reduction conducted to examine the profile control performance of a known rolling apparatus which incorporated axially-shiftable single-end tapered rolls of the type shown in FIGS. 8*b* as the intermediate rolls, together with a control by force-out of segments of divided backup rolls.

EXAMPLE 5

A 12-high rolling apparatus was built up by using, as shown in FIG. 15*a*, T-crown rolls of FIG. 8 as the work rolls, and W-crown rolls of FIG. 10 approximated by two pitches of a sine-wave curve as the intermediate rolls of one of two pairs of intermediate rolls, each pair including two rolls which are in symmetry with each other with respect to a point on the pinched portion of the rolled material. At the same time, a control by force-out of segments of divided backup rolls was used simultaneously. Using this rolling apparatus, a test rolling was conducted under the same conditions as Example 4 to examine the profile control ability of this apparatus, the results being shown in FIG. 14*b*.

As will be understood from the foregoing description, the multi-roll cluster rolling apparatus of the present invention offers excellent performance for effecting correction of rolling defects such as quarter elongation and composite elongation, as well as edge drop, not to mention the simple deformation such as edge wave and center buckle, thus realizing a superior flatness control effect over a wide range.

What is claimed is:

1. A 12-high multi-roll cluster rolling apparatus having a pair of work rolls, and a plurality of intermediate rolls and a plurality of backup rolls arranged successively behind each said work roll, wherein the improvement comprises that said intermediate rolls include at least a special pair of rolls which have a crown approximating two pitches of a sine wave curve, the rolls of said special pair being arranged in axially opposite directions to each other, each roll of said special pair being independently shiftable in an axial direction so as to realize a control of a profile of a rolled material in terms of end elongation difference ratio $\Lambda_2$ given by the following formula (1) and an end elongation difference ratio $\Lambda_4$ given by the following formula (2):

$$\Lambda_2=(l_2-l_0)/l_0 \quad (1)$$

$$\Lambda_4=(l_4-l_0)/l_0 \quad (2)$$

wherein $l_0$: length (mm) of the material after rolling as measured at breadthwise mid portion of said material;

$l_2$: length (mm) of the material after rolling as measured at breadthwise end portion of said material;

$l_4$: length (mm) of the material after rolling as measured at breadthwise quarter of said material.

2. A 12-high multi-roll cluster rolling apparatus, according to claim 1, wherein said intermediate rolls further include, in addition to said special pair of rolls, at least one other pair of rolls having a crown in which a diameter of each roll decreases towards one end thereof, the rolls of said at least one other pair being arranged in axially opposite directions to each other.

3. A 20-high multi-roll cluster rolling apparatus having a pair of work rolls, and a plurality of first intermediate rolls, a plurality of second intermediate rolls and a plurality of backup rolls arranged successively behind each said work roll, wherein the improvement comprises that said first intermediate rolls include at least a pair of rolls which have either a crown in which a diameter of each roll decreases toward one end thereof or a crown approximating two pitches of a sine wave curve, and said second intermediate rolls include at least a pair of rolls which have either a crown approximating two pitches of a sine wave curve or a crown in which a diameter of each roll decreases toward one end thereof, the rolls of each said pair being arranged in axially opposite directions to each other, each roll of said at least a pair of first intermediate rolls and said at least a pair of second intermediate rolls being independently shiftable in an axial direction so as to realize a control of a profile of a rolled material in terms of end elongation difference ratio $\Lambda_2$ given by the following formula (1) and an end elongation difference ratio $\Lambda_4$ given by the following formula (2):

$$\Lambda_2=(l^2-l_0)/l_0 \quad (1)$$

$$\Lambda_4=(l_4-l_0)/l_0 \quad (2)$$

wherein:

$l_0$: length (mm) of the material after rolling as measured at breadthwise mid portion of said material;

$l_2$: length (mm) of the material after rolling as measured at breadthwise end portion of said material;

$l_4$: length (mm) of the material after rolling as measured at breadthwise quarter of said material;

wherein said at least a pair of said first intermediate rolls have said crown in which a diameter of each roll decreases toward one end thereof and are arranged in opposite axial directions, and said at least a pair of said second intermediate rolls have said crown approximating two pitches of a sine wave curve, the rolls of each said pair being arranged in axially opposite directions to each other.

4. A 20-high multi-roll cluster rolling apparatus according to claim 3, wherein said at least a pair of said first intermediate rolls have said crown approximating two pitches of a sine wave curve, and said at least a pair of said second intermediate rolls have said crown in which a diameter of each roll decreases toward one end thereof and are arranged in opposite axial directions, the rolls of each of said pair being arranged in axially opposite directions to each other.

5. A 20-high multi-roll cluster rolling apparatus according to claim 3, wherein said first intermediate rolls include at least a pair of rolls having said crown in which a diameter of each roll decreases toward one end thereof and another pair of rolls which have said crown approximating two pitches of a sine wave curve.

* * * * *

UNITED STATES PATENT AND TRADEMARK OFFICE

CERTIFICATE OF CORRECTION

PATENT NO. : 5,218,852

DATED : June 15, 1993

INVENTOR(S) : Yuichiro WATANABE, Kazuhito KENMOCHI, and Ikuo YARITA

It is certified that error appears in the above-identified patent and that said Letters Patent is hereby corrected as shown below:

Column 9, line 6, cancel "an end" and substitute --a quarter--.

Column 10, line 5, cancel "an end" and substitute --a quarter--.

Signed and Sealed this

Twenty-sixth Day of April, 1994

*Attest:*

*Attesting Officer*

BRUCE LEHMAN

*Commissioner of Patents and Trademarks*